US007408540B1

(12) United States Patent
Fullman et al.

(10) Patent No.: US 7,408,540 B1
(45) **Date of Patent: *Aug. 5, 2008**

(54) SYSTEM AND METHOD FOR FAILSAFE DISPLAY OF FULL SCREEN HIGH FREQUENCY IMAGES ON A FLAT PANEL WITHOUT A FRAME BUFFER

(75) Inventors: Mike Fullman, Tualatin, OR (US); Nicholas Preiser, Beaverton, OR (US)

(73) Assignee: Pixelworks, Inc., Tualatin, OR (US)

( * ) Notice: Subject to any disclaimer, the term of this patent is extended or adjusted under 35 U.S.C. 154(b) by 24 days.

This patent is subject to a terminal disclaimer.

(21) Appl. No.: 11/609,238

(22) Filed: Dec. 11, 2006

Related U.S. Application Data

(63) Continuation of application No. 10/663,461, filed on Sep. 15, 2003, now Pat. No. 7,164,416.

(51) Int. Cl.
*G09G 5/00* (2006.01)

(52) U.S. Cl. ..... 345/204; 345/691

(58) Field of Classification Search ..... 345/3.1–3.4, 345/87, 204, 691, 698, 699
See application file for complete search history.

(56) References Cited

U.S. PATENT DOCUMENTS

| | | | |
|---|---|---|---|
| 5,506,602 | A | 4/1996 | Yokoyama |
| 5,784,037 | A | 7/1998 | Inoue |
| 6,014,126 | A | 1/2000 | Nishihara |
| 6,339,422 | B1 | 1/2002 | Kuwajima et al. |
| 6,545,653 | B1 | 4/2003 | Takahara et al. |
| 2003/0234801 | A1 | 12/2003 | Eglit et al. |

*Primary Examiner*—Ricardo L Osorio
(74) *Attorney, Agent, or Firm*—Marger, Johnson & McCollom, P.C.

(57) ABSTRACT

The invention relates to a system and method for visually displaying data and, more particularly, to a system and method for displaying full screen high frequency data on a flat panel without using a frame buffer. The system and method displays a full screen, color, image that allows a user to adjust its computer back to a correct setting. That is, to exit the high frequency mode that produced the high frequency digital data in the first instance without having to connect a CRT, reboot, or the like. The system and method drives the panel's rows and columns so as to display interlaced data, thereby reducing the effective vertical frequency of the data. Because the human eye is incapable of perceiving the blank lines, the screen appears complete just as it does in the normal mode.

29 Claims, 10 Drawing Sheets

FIGURE 11
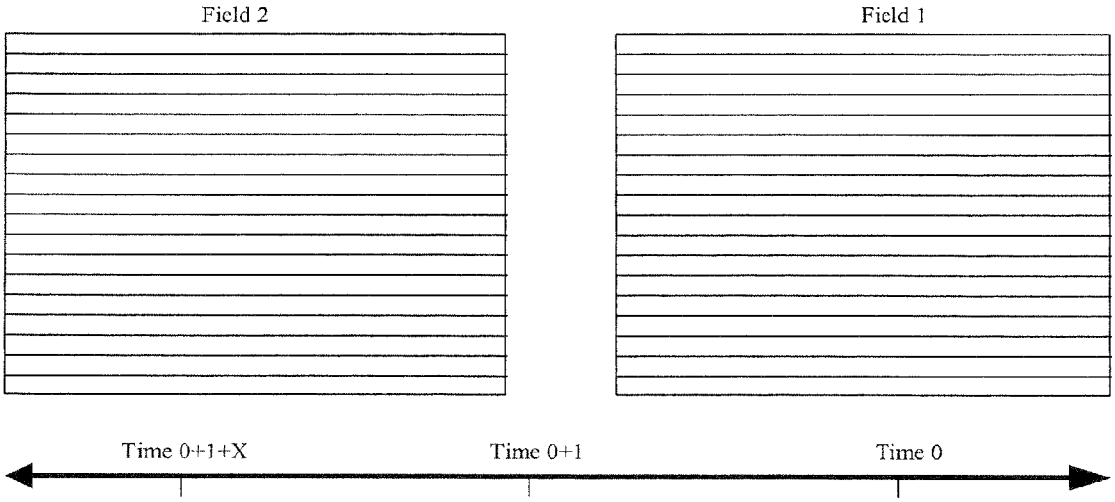
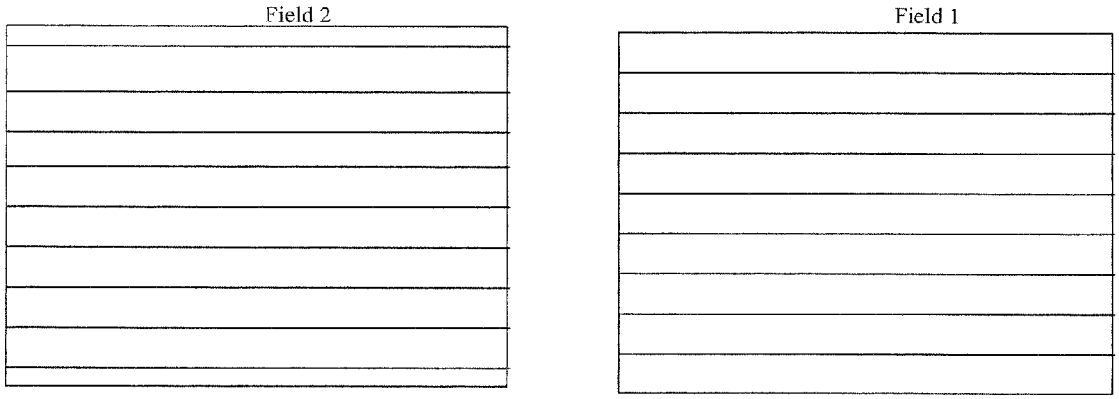
FIGURE 12

SYSTEM AND METHOD FOR FAILSAFE DISPLAY OF FULL SCREEN HIGH FREQUENCY IMAGES ON A FLAT PANEL WITHOUT A FRAME BUFFER

This application is a continuation of U.S. patent application Ser. No. 10/663,461, filed Sep. 15, 2003, and is herein incorporated by reference.

FIELD OF THE INVENTION

This invention relates to a system and method for visually displaying data and, more particularly, to a system and method for displaying full screen high frequency data on a flat panel without using a frame buffer.

BACKGROUND OF THE INVENTION

Active matrix liquid crystal displays (LCDs), e.g., thin film transistor (TFT) panels, can display images having a vertical frequency not greater than about 75 Hz due to physical limitations associated with the panel's glass. Some TFT panels can display images with vertical frequencies between 75 and 85 Hz. But those images must be vertically scaled before being displayed, severely distorting the image.

Computer video cards, for example, can output video images with extremely high vertical frequencies. These high frequency images are typically intended for cathode ray tube (CRT) monitors capable of displaying them and not TFT panels. If a user sets the computer into a high frequency video mode, a typical TFT panel will show a blank screen. The user, then, is left with a computer in a mode that lie has little ability to change since he cannot navigate the computer settings without the panel's visual aid. Even if the user reboots his computer, most operating systems will likely start up in the mode exited. The user can replace the TFT display with a CRT monitor, but this solution is cumbersome, time consuming, and requires the user to have a spare CRT.

Accordingly, a need remains for a system and method for displaying high frequency images on a flat panel without using a frame buffer.

BRIEF DESCRIPTION OF THE DRAWINGS

The foregoing and other objects, features, and advantages of the invention(s) will become more readily apparent from the detailed description of invention embodiments that references the following drawings.

FIG. 11 is a data diagram for the normal mode.

FIG. 12 is a data diagram for the failsafe mode.

DESCRIPTION OF THE INVENTION

Figure 1:
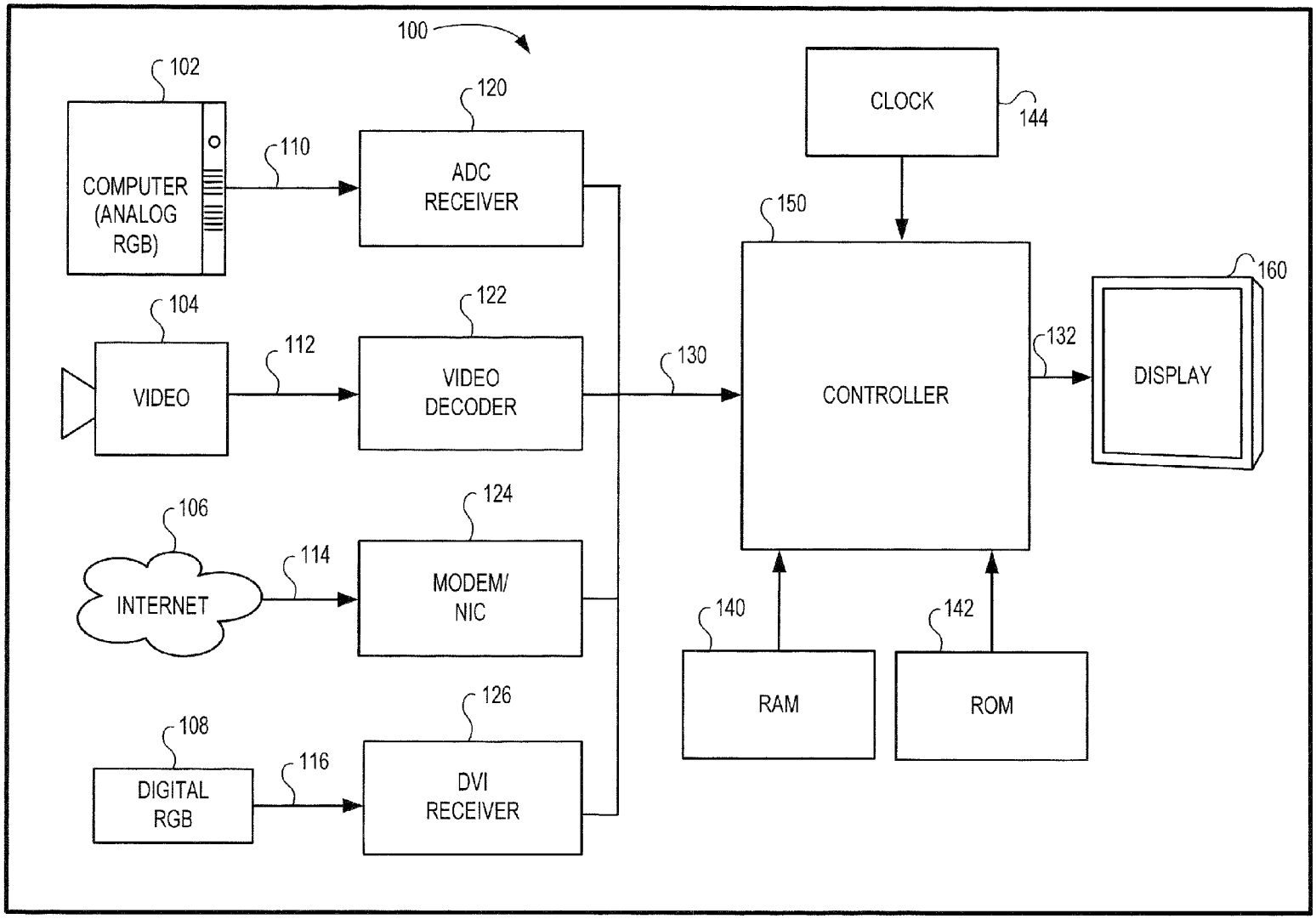
FIG. 1 is a system block diagram.

FIG. 1 is a block diagram of a system 100 adapted to display an image. The system includes a receiver 120 for receiving an analog image data signal 110, e.g., an RGB signal, from a source 102. The receiver 120 might be an analog-to-digital converter (ADC) or the like. The source 102 might be a personal computer or the like. The receiver 120 converts the analog image data signal 110 into digital image data 130 and provides it to the display controller 150.

Likewise, a video receiver or decoder 122 decodes an analog video signal 112 from a video source 104. The video source 104 might be a video camcorder and the like. The decoder 122 converts the analog video signal 112 into digital image data 130 and provides it to the display controller 150.

A modem or network interface card (NIC) 124 receives digital data 114 from a global computer network 106 such as the Internet®. The modem 124 provides digital image data 130 to the display controller 150.

A Digital Visual Interface (DVI) receiver 126 receives digital RGB signals 116 from a digital RGB source 108. The DVI receiver 126 provides digital image data 130 to the display controller 150.

A person of reasonable skill in the art should recognize that other sources and other converters come within the scope of the present invention.

The display controller 150 generates image or display data 132 by manipulating the digital image data 130. The display controller 150 provides the image data 132 to a flat panel display device 160. The panel 160 is any device capable of displaying digital image data 130. In one embodiment, the panel 160 is a pixelated display that has a fixed pixel structure. Examples of pixelated displays are active and passive LCD displays, plasma displays (PDP), field emissive displays (FED), electro-luminescent (EL) displays, micro-mirror technology displays, low temperature polysilicon (LTPS) displays, and the like for use in television, monitor, projector, hand held, and other like applications.

Figure 8:
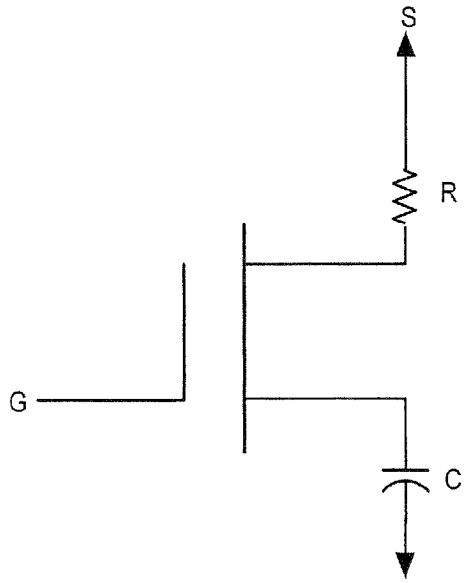
FIG. 8 is a TFT schematic diagram.

A subset of LCD panels is TFT active matrix panels. TFT describes the control elements that actively control the individual pixels. Referring to FIG. 8, a TFT 800 includes a capacitor C that is charged responsive to a driving gate voltage G and includes an inherent source resistance R charging from the source driver S. A constant determined by the product of the source resistance R and the capacitor C sets a time necessary to fully charge the capacitor C.

In one embodiment, the display controller 150 might scale the digital image data 130 for proper display on the display device 160 using a variety of techniques including pixel replication, spatial and temporal interpolation, digital signal filtering and processing, and the like. In another embodiment, the controller 150 night additionally change the resolution of the digital image data 130, changing the frame rate and/or pixel rate encoded in the digital image data 130. Scaling, resolution, frame, and/or pixel rate conversion, and/or color manipulation are not central to this invention and are not discussed in further detail. A person of reasonable skill in the art should recognize that the controller 150 manipulates the digital image data 130 and provides display data 132 to a display device 160 that is capable of properly displaying a high quality image regardless of display type.

Read-only (ROM) and random access (RAM) memories 140 and 142, respectively, are coupled to the display system controller 150 and store bitmaps, FIR filter coefficients, and the like. A person of reasonable skill in the art should recognize that the ROM and RAM memories 140 and 142, respectively, might be of any type or size depending on the application, cost, and other system constraints. A person of reasonable skill in the art should recognize that the ROM and RAM memories 140 and 142 might not be included in the system 100. A person of reasonable skill in the art should recognize that the ROM and RAM memories 140 and 142 might be external or internal to the controller 150. Clock 144 controls timing associated with various operations of the controller 150.

Figure 2:
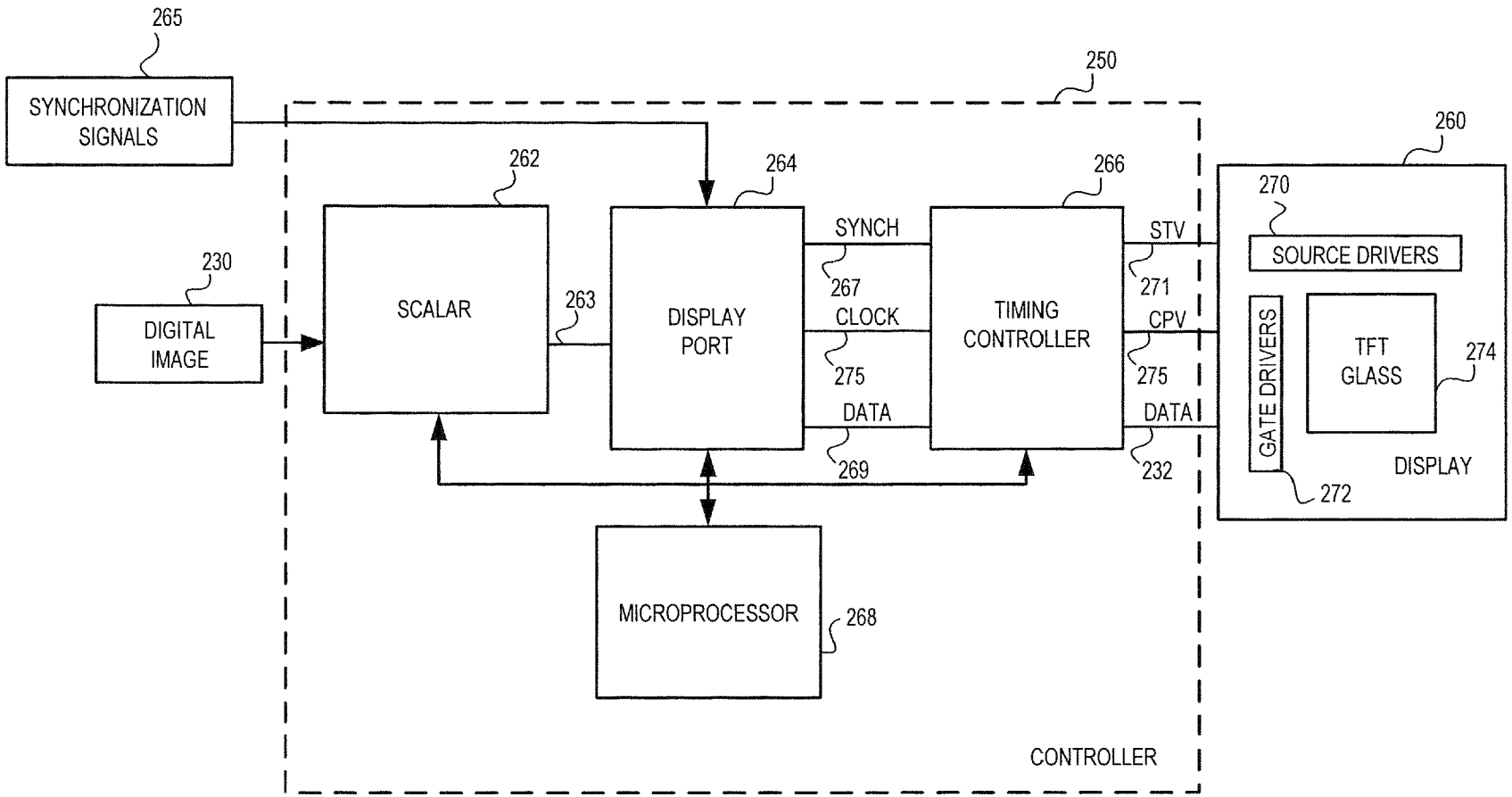
FIG. 2 is a controller block diagram.

FIG. 2 is a block diagram of an embodiment of the controller 150 shown in FIG. 1. Referring to FIG. 2, a controller 250 includes a microprocessor 268, scalar 262, display port 264, and timing controller (TCON) 266. A person of reasonable skill in the art should recognize that the controller 250 includes other functional blocks not shown in FIG. 2 for simplicity. These functional blocks include memory, memory controller, on screen display capability, image optimization, synchronization signal decoder and timer, pixel processing, color corrector, gain, color lookup table, and the like (not shown). The display controller 250 might further include a full complement of microprocessor peripherals (not shown). In one embodiment, the controller includes I/O ports (e.g., 8-bit I/O ports), an infrared decoder, timers (e.g., 16-bit timers), a watchdog timer, a programmable interrupt controller, an RS-232 serial port, ROM and RAM interface, and decode logic for external peripherals (not shown). In another embodiment, the controller 250 might include the above mentioned microprocessor peripherals on-chip, allowing a complete microprocessor system to be implemented by merely adding external memory such as RAM 140 and ROM 142 shown in FIG. 1.

The microprocessor 268 is adapted to perform all of the control functions necessary for the display controller 250. For example, the microprocessor 268 might control the scalar 262, display port 264, timing controller 266, and any other functional block diagram included in the controller 250. In one embodiment, the microprocessor 268 is an integrated (on-chip) general purpose, microprocessor, e.g., a 16-bit, x86-compatible processor with up to 32 Kbytes of RAM. In another embodiment, the microprocessor 268 is coupled externally to (off chip), not integrated with, the display controller 250. The microprocessor 268 might run at high clock rates, e.g., 50 MHz. The microprocessor 268 might include a large address space, e.g., of up to a one-megabyte. A person of reasonable skill in the art should recognize that the configuration of the microprocessor 268 varies with the specific application, cost, size, and speed, as well as other constraints.

The scalar 262 scales digital image data 230 for proper display on the flat panel 260. The scalar 262 might employ any one of a variety of well-known scaling techniques including pixel replication, spatial and temporal interpolation, digital signal filtering and processing, and the like. The scalar 263 might scale the digital image data 230 in cooperation with an image memory (not shown), e.g., a frame memory. The scalar 262 provides the scaled data 263 to a display port 264 for further processing.

The display port 264 includes a display timing generator capable of generating display synchronization signals 267 and clock 275 associated with the data 269. The timing controller 266 drives the panel 260 responsive to the display synchronization signals 267 and the clock 275 received from the display port 264. The display synchronization signals 267 are, e.g., vertical and horizontal synchronization signals.

The display port 264 additionally provides the data 269 to the timing controller 266. The display port 264 provides the data 269 in any of a variety of formats suitable for display on the panel 260. In one embodiment, the display port 264 provides the data 269 in a Reduced Swing Differential Signal (RSDS) format to the timing controller 266. A person of reasonable skill in the art should recognize that the data 269 might have other formats depending on the panel 260.

The panel 260 includes a glass 274 and source and gate drivers 270 and 272, respectively. In one embodiment, the glass 274 comprises polarizer and color filters, alignment layers, and the actual glass panel. The source drivers drive the panel 260's columns with the display data 232 while the gate drivers 272 drive or turn on the individual TFT's to let the data 232 pass through. That is, the gate drivers 272 provide the TFT's, e.g., TFT 800, with the gate voltage G.

The timing controller 266 generates control signals to drive the panel 260. For example, the timing controller generates a start pulse vertical (STV) 271 and clock pulse vertical (CPV) 273 signals to drive the gate drivers 272. An embodiment of the present invention relates to active timing controllers (TCONs). Active TCONs adaptively change their output, e.g., display data 232 and STV and CPV pulses, responsive to predetermined circumstances, e.g., the data's vertical frequency. Put differently, the active TCON 266 adapts its output to certain changes in its input.

Figure 3:
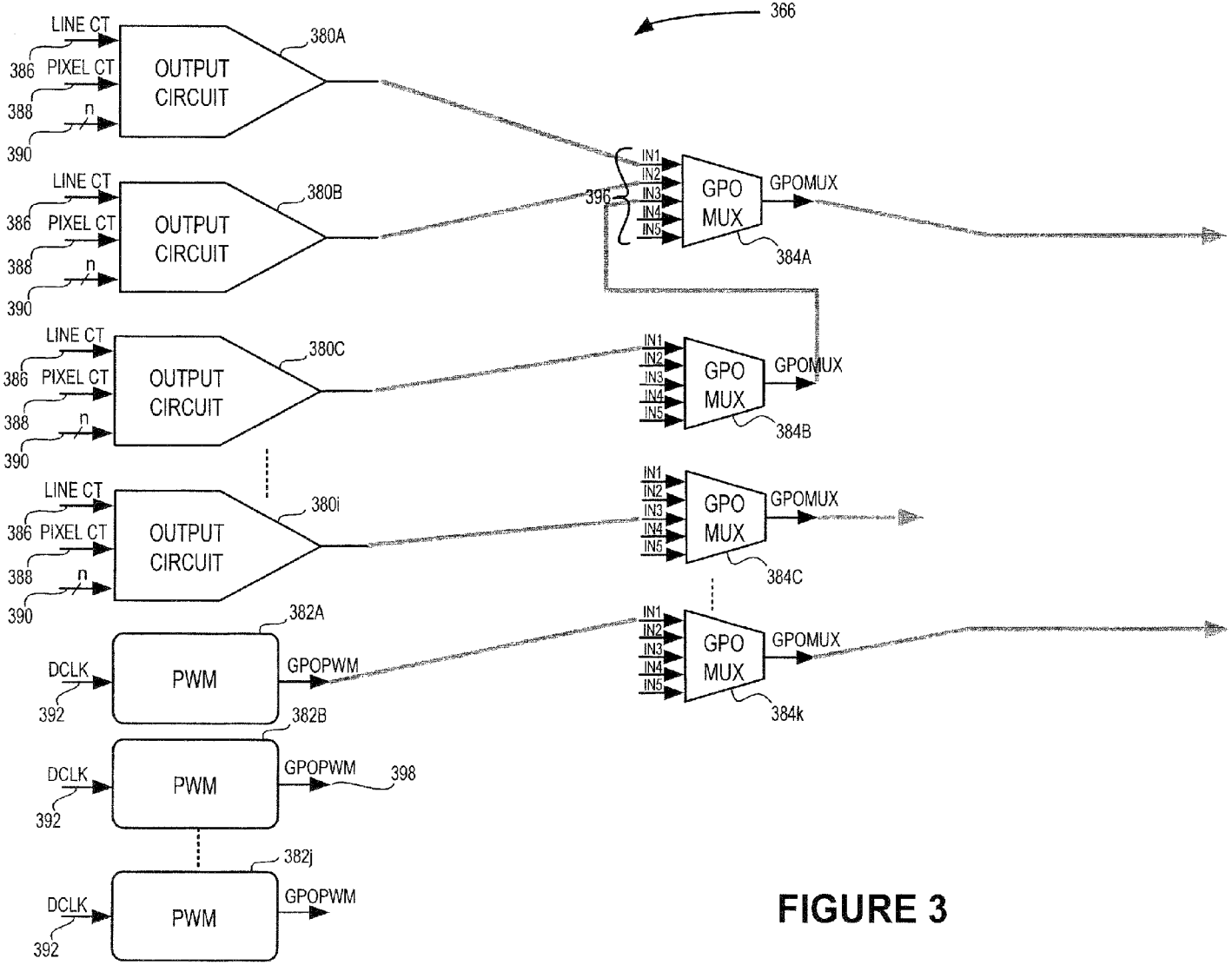
FIG. 3 is a timing controller circuit block diagram.

FIG. 3 is a block diagram of one embodiment of the timing controller 266 shown in FIG. 2. Referring to FIGS. 2-3, the TCON 366 includes a plurality of output circuits, e.g., 380A, 380B, . . . , 380*i*, a plurality of pulse width modulation circuits, e.g., 382A, 382B, . . . , 382*j*, and a plurality of multiplexer circuits 384A, 384B, . . . , 384*k*.

The output circuits 380A, 380B, . . . , 380*i* generate an output that is a function of line count 386, pixel count 388, and a plurality of inputs 390. The line count 386 represents a vertical line count of the image to be displayed. The pixel count 388 represents a horizontal pixel count of the image to be displayed. In one embodiment, the output circuits 380A, 380B, . . . , 380*i* are programmable function generators that can provide an output 394 that is a function of the line count 386, pixel count 388, and plurality of inputs 390. The output 394 is provided to any one of the plurality of multiplexer circuits 384A, 384B, . . . , 384*k*. A person of reasonable skill in the art should understand that the output circuits 380A, 380B, . . . , 380*i* can be programmed to output any of a variety of functions according to its input.

The plurality of pulse width modulation circuits 382A, 382B, . . . , 382*j* generate a pulse width modulated output 398 responsive to the display clock 392. The pulse width modulated output 398 might, for example, be provided to the multiplexer circuits 384A, 384B, . . . , 384*k*. In one embodiment, the plurality of pulse width modulation circuits 382A, 382B, . . . , 382*j* are programmable.

Figure 6:
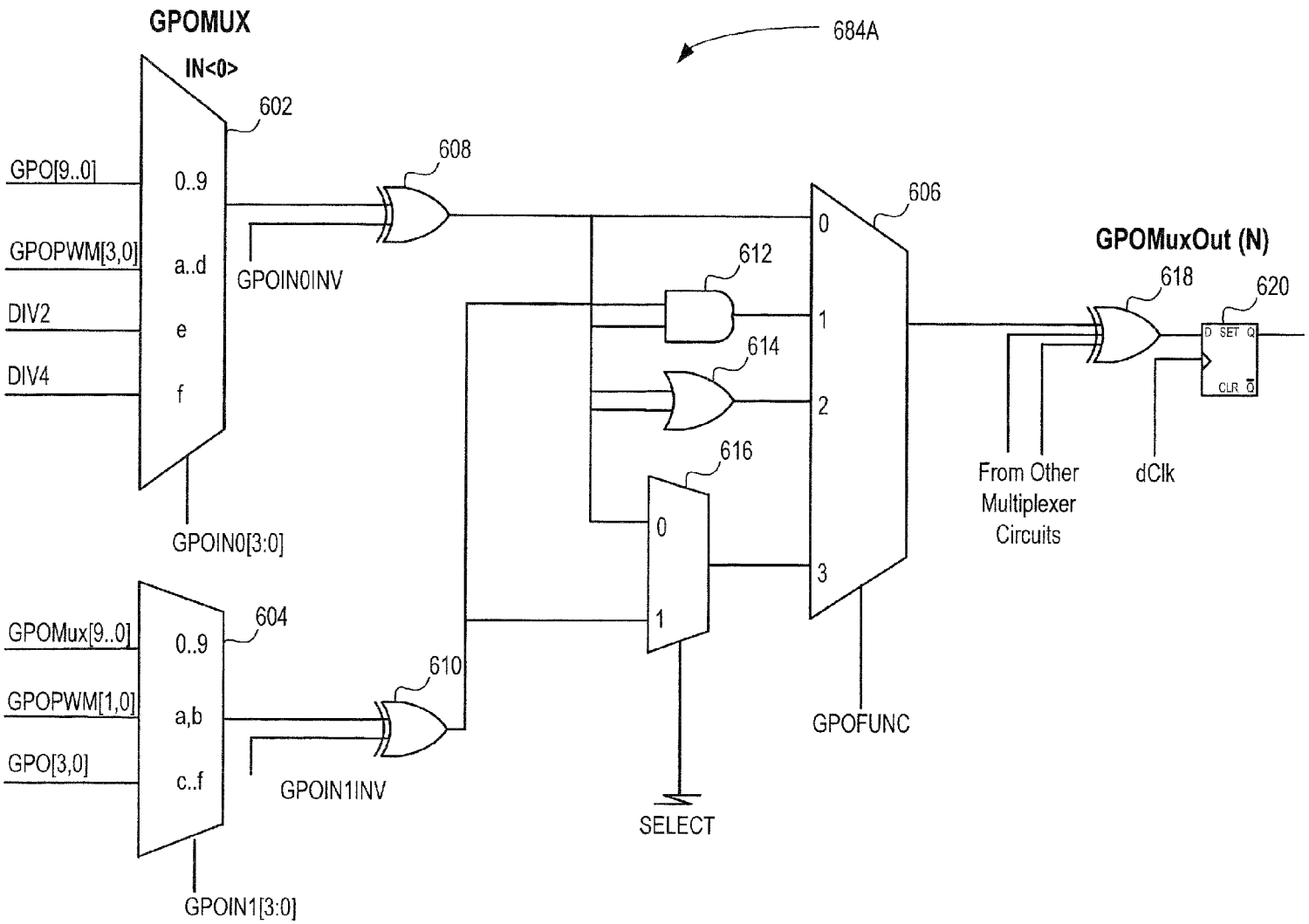
FIG. 6 is a multiplexer circuit schematic diagram.

The plurality of multiplexer circuits 384A, 384B, . . . , 384*k* selects among its plurality of inputs 396 responsive to an input (e.g., input GPOIN0[0 . . . 3]) shown in FIG. 6. In one embodiment, the multiplexer circuits 384A, 384B, . . . , 384*k* are programmable selection circuits that can select among the plurality of inputs 396 responsive to other programmable inputs (e.g., input GPOIN0[0 . . . 3]).

The operation and structure of the plurality of output circuits 380A, 380B, . . . , 380*i*, pulse width modulation circuits 382A, 382B, . . . , 382*j*, and multiplexer circuits 384A, 384B, . . . , 384*k* is explained in more detail with reference to FIGS. 4-6. For simplicity, a single output circuit, pulse width modulation circuit, and multiplexer will be shown and explained. A person of reasonable skill in the art should recognize that other embodiments of these circuits come within the scope and spirit of the present invention.

The actual implementation is provided as reference only and is just one example of a programmable TCON. A person of reasonable skill in the art should recognize that other implementations of programmable TCONs come under the scope and spirit of the present invention.

Figure 4:
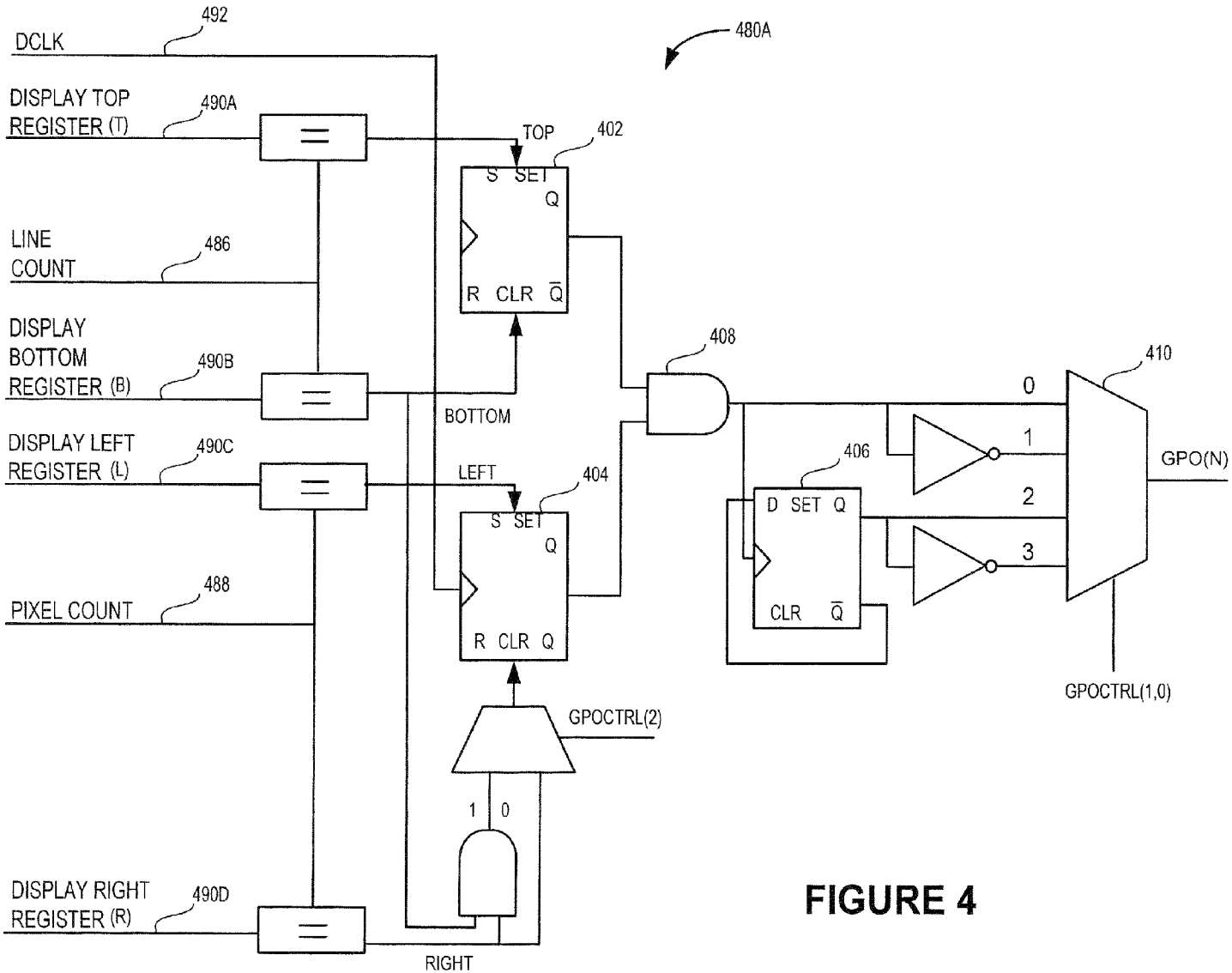
FIG. 4 is an output circuit schematic diagram.
Figure 7:
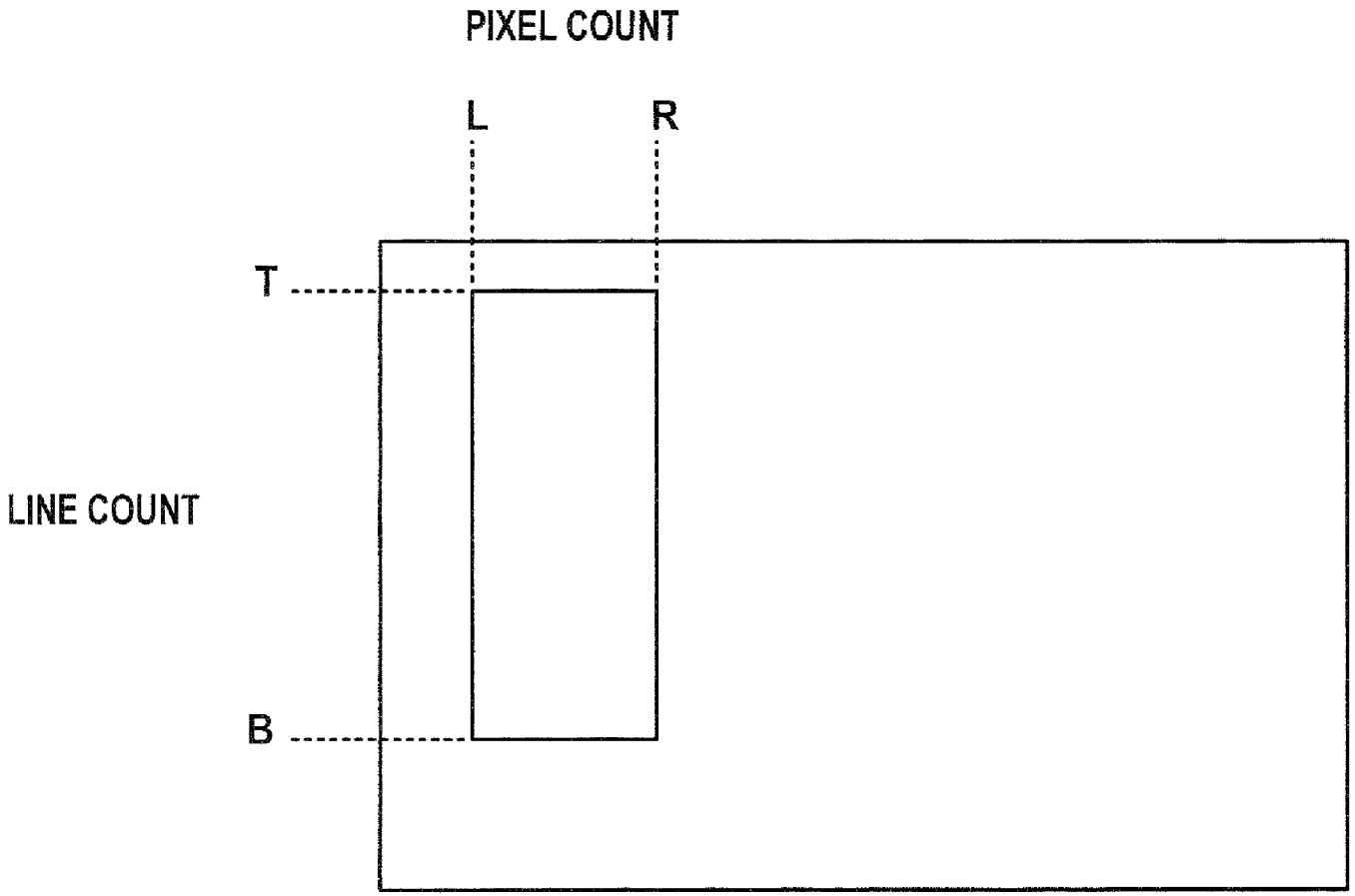
FIG. 7 is an output circuit register diagram.

Referring to FIGS. 4 and 7, an output circuit 480A receives the line count 486, pixel count 488, display clock 492 as well as a plurality of programmable inputs. In one embodiment, the plurality of programmable inputs includes a display top register 490A for indicating a top position of the image to be displayed, a bottom register 490B for indicating a bottom position of the image to be displayed, a left register 490C for indicating a left most position of the image to be displayed, and a right register 490D for indicating a right most position of the image to be displayed. The top, bottom, left, and right positions of the image to be displayed are indicated by the references T, B, L, and R, respectively, in FIG. 7.

The output circuit 480A includes at least two set/reset flip flops 402 and 404 and a D flip flop 406. A set input of the flip flop 402 is set when the line count 486 equals the top register 490A while its reset (or clear) input is set when the line count 486 equals bottom register 490B. A set input of the flip flop 404 is set when the pixel count 488 equals the left register 490C. The flip flop 404 resets when the line count 486 equals the bottom register 490B and the pixel count 488 equals the right register 490D responsive to an GPOCTRL(2) input. In one embodiment, the GPOCTRL(2) input is programmable. A logic gate 408 logically manipulates the outputs of the set/reset flip flops 402 and 404 and provides the results to the D flip flop 406 and to a multiplexer 410. The multiplexer 410 selects among its inputs responsive to a GPOCTRL(1,0) control input. In one embodiment, the GPOCTRL(1,0) control input is programmable.

Figure 5:
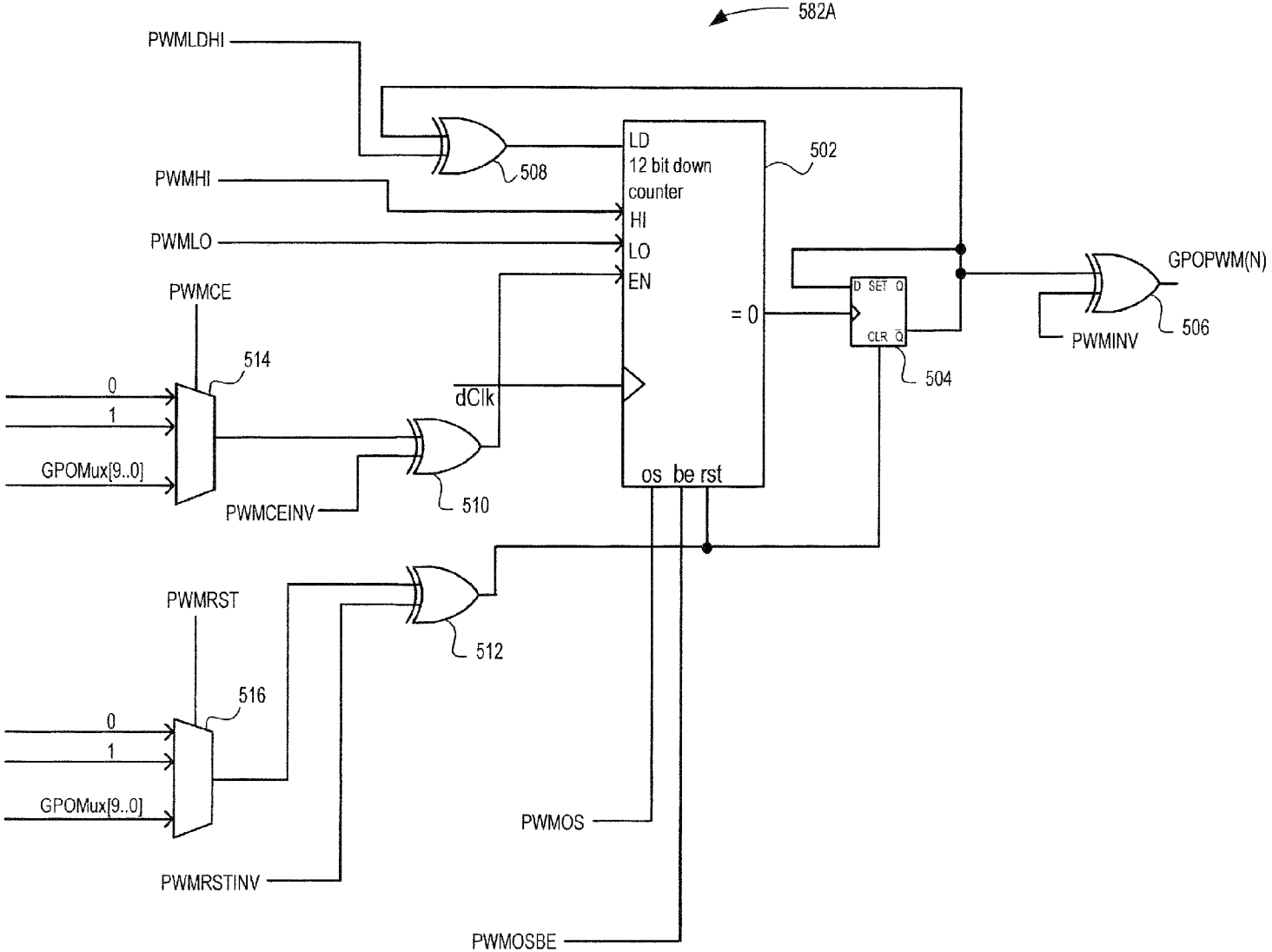
FIG. 5 is a pulse width modulation circuit schematic diagram.

Referring to FIG. 5, a pulse width modulation circuit 582A includes a counter 502 and a plurality of logic gates, e.g., gates 506, 508, 510, and 512. The counter 502 receives a plurality of inputs, e.g., PWMLDHI, PWMHI, PWMLO, PWMOS, PWMOSBE, and the like. In one embodiment, each of the plurality of inputs, e.g., PWMLDHI, PWMHI, PWMLO, PWMOS, PWMOSBE, and the like is a programmable register. The counter 502 operates responsive to the display clock DCLK.

Multiplexers 514 and 516 select from various inputs, including logic high and lo inputs and inputs from any of the multiplexer circuits, e.g., multiplexers 384A, 384B, . . . , 384*k*. The multiplexer 514 makes its selection responsive to an input PWMCE. The multiplexer 516 makes its selection responsive to an input PWMRST. In one embodiment, PWMCE and PWMRST are programmable registers. Logic gate 510 logically manipulates the output of the multiplexer 514 together with a PWMCEINV signal and provides the result to the EN input of the counter 502. A logic gate 512 logically manipulates the output of the multiplexer 516 together with a PWMRSTINV signal and provides the result to the reset input of the counter 502 and the D flip flop 504. A logic gate 506 inverts the output of the flip flop 504 responsive to the PWMINV input.

Referring to FIG. 6, a multiplexer circuit 684A includes a multiplexers 602, 604, 606, and 616 that operate responsive to various inputs including GPOIN0[3 . . . 0], GPOIN1[3 . . . 0], and GPOFUNC. In one embodiment, the inputs GPOIN0[3 . . . 0], GPOIN1[3 . . . 0], and GPOFUNC are programmable registers. A plurality of logic gates including 608, 610, 612, and 618, logically manipulate its corresponding inputs as shown in FIG. 6. A multiplexer 614 selects between the outputs of gates 608 and 610 responsive to a SELECT input. A D flip flop 620 provides the multiplexer circuit 684A's output responsive to the display clock DCLK.

Methods of the invention are now described. A person having ordinary skill in the art should recognize that the boxes described below might be implemented in different combinations, and in different order. Some methods may be used for determining a location of an object, some to determine an identity of an object, and some both.

Methods of the invention are now described. A person having ordinary skill in the art should recognize that the boxes described below might be implemented in different combinations, and in different order. Some methods may be used for determining a location of an object, some to determine an identity of an object, and some both.

Referring to FIGS. 2, 9A-B, and 10-12 an embodiment of the controller 250 operates as follows. The controller 250 receives digital image data 230 (box 1002) and the associated synchronization signals 265, e.g., vertical and horizontal synchronization signals (Box 1004). The display port 264 determines the vertical frequency of the incoming data 230 responsive to the synchronization signals 265 (box 1006). In one embodiment, the vertical frequency is measured by comparing a reference clock to an input vertical VSYNC period. A person of reasonable skill in the art knows several well-known methods to determine the vertical frequency of the data 230, e.g., by analyzing and deconstructing the synchronization signal 265.

The controller 250 compares the vertical frequency of the data 230 with that of the display 260 (box 1008). If the vertical frequency of the data 230 is not greater than the allowed vertical frequency of the display 260, the controller 250 operates in a normal mode providing the image data 232 to the display 260 (box 1010).

Figure 9A:
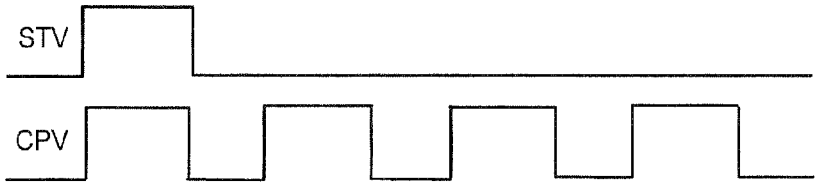
FIG. 9A is a control signal timing diagram for the normal mode.

The normal mode is shown in FIG. 11. In this mode, the controller 250 writes data 232 to the panel 260 sequentially, starting from the top left corner. The top line is written, then the next line, and so on until the screen bottom is reached. After a single image field fills the screen, the sequence restarts at the top left corner. In the normal mode, the controller 250 generates a vertical clock pulse CPV and a start pulse vertical SPV as shown in FIG. 9A. The STV pulse sequentially pulses the gate driver outputs on the panel 260 responsive to the CPV pulse.

If, on the other hand, the vertical frequency of the data 230 is in excess of a vertical frequency supported by the panel 260, the controller 250 operates in a failsafe mode (box 1012). For example, if the data 230 has a vertical frequency in excess of 75 Hz, the panel 260 will go blank since it cannot display the data 230. Any number of devices operating in any number of modes is capable of generating data 230 that exceeds the panel's vertical frequency, including a personal computer in a video game mode.

In the failsafe mode, the controller 250 displays a full screen, color, image that allows a user to adjust its computer back to a correct setting (that is, to exit the high frequency mode that produced the high frequency digital data 230 in the first instance) without having to connect a CRT, reboot, or the like.

The controller 250 provides the panel 260 with interlaced data 232 as shown in FIG. 12. That is, the controller 250 provides only every other line of data 232 to the panel 260, for each field or screen. After completing a single field, the controller 250 shifts the output up or down a line based on the previous field. By doing so, the controller 250 does not overlap fields, but rather writes lines where the previous field left blank lines. Because the charge capacitor on the TFT (capacitor C shown in FIG. 8) will carry charge through a frame time, the human eye is incapable of perceiving the blank lines, the screen appears complete just as it does in the normal mode. But the panel 260 operates at a fraction, e.g., half, the vertical frequency of the data 230. The controller 250 effectively uses the TFT storage capacitor C (FIG. 8) as a frame storage buffer without requiring one on the controller 250. The result is both cost and design effective.

Figure 9B:
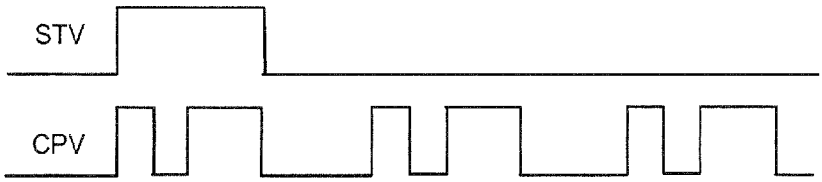
FIG. 9B is a control signal timing diagram for the failsafe mode.
Figure 10:
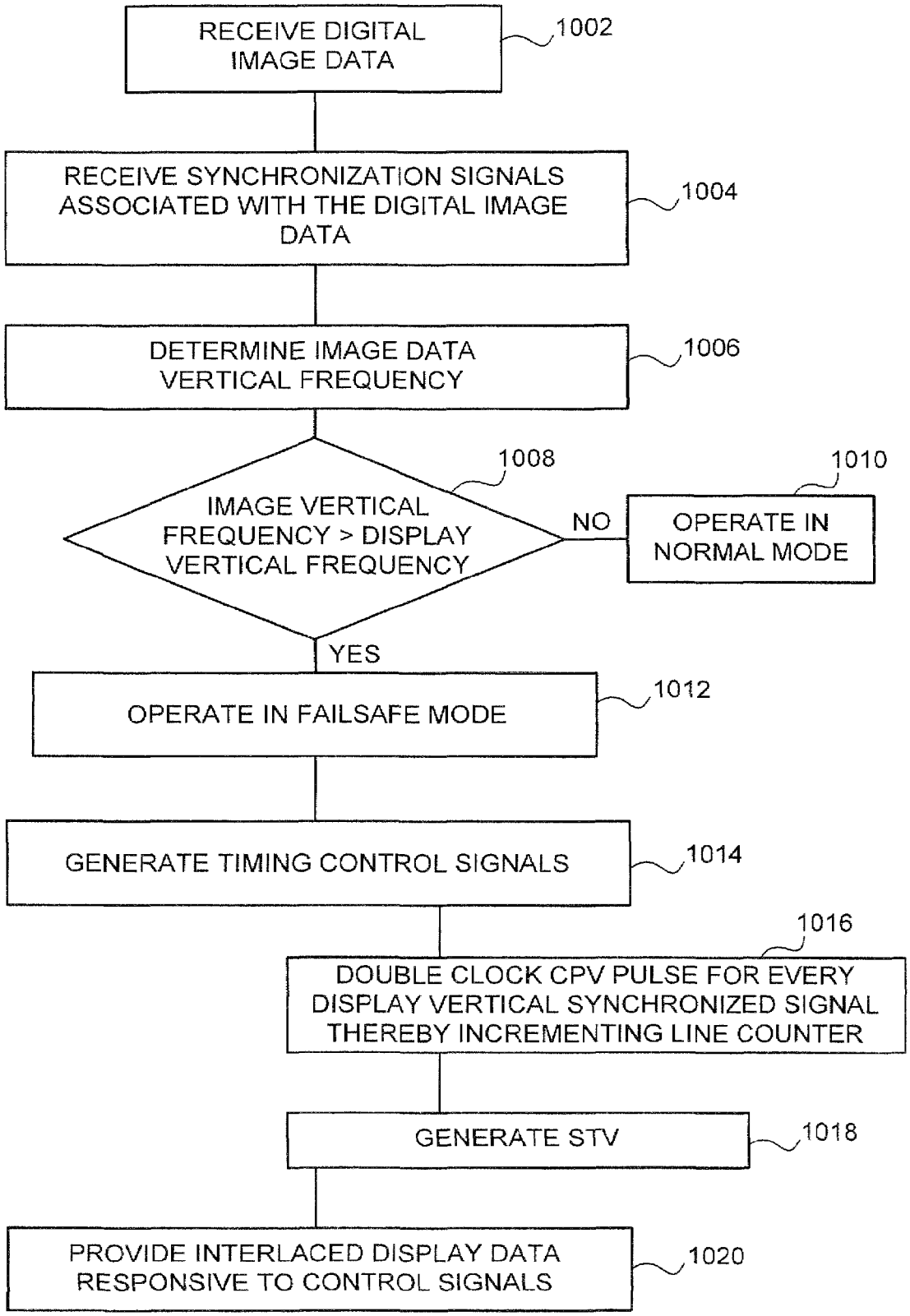
FIG. 10 is a method flowchart.

In one embodiment, the timing controller 266 performs the interlacing as follows. At box 1014, the timing controller 266 generates display control signals, e.g., a clock vertical pulse CPV (box 1016) and a start vertical pulse STV (box 1018). In one embodiment, the timing controller 266 double clocks the CPV pulse as shown in FIG. 9B. The timing controller 266 double clocks the CPV pulse once for every display vertical synchronization signal. In one embodiment, the first pulse is short relative to the second CPV pulse. Example pulse durations are 20 microseconds for the STV pulse and 5 microseconds high and 5 microseconds low for the CPV pulse. A person of reasonable skill in the art understands that other pulsing configurations of CPV are possible.

Each CPV pulse causes the gate driver output control counter to increment, forcing data to be output every other line (line, line +2, . . . ). The result is that the timing controller 266 provides every other data line to the panel 260, thereby interlacing the data (box 1020), reducing the data's vertical frequency, and allowing the display to present a full screen, color image (instead of a blank screen).

And the controller 250 begins a continuous programming cycle designed to reset the scalar 262. In addition to modifying the CPV and STV pulse relationship, the controller 250 adjusts the data such that the proper information is sent to the display. Any reasonable method of selecting only odd or even lines of data from the input field can be used. In one embodiment, the controller 250 reprograms the scalar 262's vertical even offset register YE and vertical odd offset register YO such that the output is offset by a single line every time a complete field. The controller 250 programs the YE and YO registers to shift the output image down or up one line responsive to the previous field location. The controller 250 programs the YE and YO registers responsive to a vertical synchronization signal. By careful selection of filter settings, the controller 250 is able to select between even and odd input data for proper display on the panel 260.

The controller 250 might be integrated into a monolithic integrated circuit. Any number of discrete logic and other components might alternatively implement the invention. A dedicated processor system that includes a microcontroller or a microprocessor might to alternatively implement the present invention. And the controller 250 might be implemented in software.

Having illustrated and described the principles of our invention(s), it should be readily apparent to those skilled in the art that the invention(s) can be modified in arrangement and detail without departing from such principles. We claim all modifications coming within the spirit and scope of the accompanying claims.

We claim:

1. A timing controller, comprising:

a clock pulse circuit capable of generating a clock pulse responsive to a synchronization signal, the clock pulse having at least two pulses for every synchronization signal; and a start pulse circuit capable of generating a start pulse responsive to the clock pulse, where the start pulse is programmed to occur coincident with a first line of a first field and with a second line of a second field.

2. The timing controller of claim 1 where the clock pulse is capable of skipping every other data line responsive to the clock pulse.

3. The timing controller of claim 1 where the clock pulse increments a line counter.

4. The timing controller of claim 1 where the start pulse sequentially drives panel rows responsive to the clock pulse.

5. A timing controller, comprising:

an output circuit capable of generating a function responsive to a top, bottom, left, and right position and a display clock;

a pulse width modulation circuit capable of generating a modulated pulse responsive to the display clock; and a multiplexer circuit capable of selecting one of a plurality of inputs including the function responsive to the display clock.

6. The timing controller of claim 5, where the timing controller is configured to generate a start pulse signal and a clock pulse signal for driving a panel responsive to predetermined characteristics of image data.

7. The timing controller of claim 6, where the timing controller is further configured to provide interlaced image data to the panel responsive to the start pulse signal and the clock pulse signal.

8. The timing controller of claim 6, where the image data includes vertical synchronization signals.

9. The timing controller of claim 8, where the clock pulse signal is pulsed at least twice for every vertical synchronization signal of the image data.

10. The timing controller of claim 6, where the start pulse signal is configured to sequentially activate rows of the panel responsive to the clock pulse signal.

11. The timing controller of claim 10, where the start pulse signal is further configured to sequentially activate every other row of the panel responsive to the clock pulse signal.

12. The timing controller of claim 6, where the predetermined characteristics include a vertical image frequency.

13. The timing controller of claim 6, where the clock pulse signal increments a line counter such that the timing controller skips every other image line in the image data.

14. The timing controller of claim 6, where the output circuit comprises: a plurality of set/reset flip flops capable of operating responsive to the display clock; at least one d-flip flop capable of operating responsive to outputs of the set/reset flip flops; and a plurality of logic gates capable of logically manipulating the outputs of the set/reset flip flops and the d-flip flop.

15. The timing controller of claim 5, where the output circuit is programmable.

16. The timing controller of claim 5, where the pulse width modulation circuit comprises a programmable counter capable of operating responsive to the display clock.

17. The timing controller of claim 5, where the multiplexer circuit is capable of selecting between outputs generated by the output circuit.

18. A timing controller comprising:

means for timing a panel capable of generating a vertical start pulse signal and a vertical clock pulse signal responsive to predetermined characteristics of display data comprising:

output means for generating a function responsive to a top, bottom, left, and right position and a display clock;

pulse width modulation means for generating a modulated pulse responsive to the display clock; and multiplexer means for selecting one of a plurality of inputs including the function responsive to the display clock.

19. The timing controller of claim 18 where the display data includes vertical synchronization signals and the means for timing the panel includes means for generating at least two clock pulses for every vertical synchronization signal of the display data.

20. The timing controller of claim 19 comprising means for incrementing a line counter responsive to the clock pulses.

21. The timing controller of claim 18 where the means for timing the panel generates the vertical start pulse signal and the vertical clock pulse signal such that every other line of the display data is provided to the panel.

22. A method, comprising:

generating timing control signals for driving rows and columns of a panel, comprising:

generating a function responsive to top, bottom, left, and right positions and a display clock;

modulating a pulse responsive to the display clock; and selecting one of a plurality of inputs including the function responsive to the display clock.

23. The method of claim 22, further comprising receiving display data, the display data comprising predetermined characteristics and vertical synchronization signals, and generating the timing control signals responsive to the predetermined characteristics.

24. The method of claim 23, where generating the timing control signals includes generating at least two vertical clock pulses for each vertical synchronization signal in the display data.

25. The method of claim 24, where a first vertical clock pulse is shorter than a second vertical clock pulse.

26. The method of claim 23 where generating the timing control signals includes generating at least two vertical clock pulses responsive to a predetermined vertical frequency of the display data.

27. The method of claim 22, where the timing control signals comprise a vertical start pulse signal and a vertical clock pulse signal.

28. The method of claim 27 where generating the timing control signals includes incrementing a line counter with each vertical clock pulse in the vertical clock pulse signal.

29. The method of claim 27 where generating the timing control signals includes generating the vertical start pulse signal such that it activates alternating lines on alternating fields on the panel.

* * * * *